United States Patent [19]

Jackson

[11] 4,069,006

[45] Jan. 17, 1978

[54] HOUSEHOLD AND BARBECUE TORCH LIGHTER

[76] Inventor: Crowell B. Jackson, 179 E. 79th St., New York, N.Y. 10021

[21] Appl. No.: 701,093

[22] Filed: June 30, 1976

[51] Int. Cl.[2] ..... A21D 2/00

[52] U.S. Cl. ..... 431/344; 222/402.14; 251/90; 431/277

[58] Field of Search ..... 431/277, 344, 253, 350, 431/156, 130, 131, 142, 143, 150, 254, 255, 256, 276; 222/402.14, 402.15; 251/90

[56] References Cited

U.S. PATENT DOCUMENTS

| | | | |
|---|---|---|---|
| 514,897 | 2/1894 | Bonroe | 251/100 |
| 1,369,754 | 2/1921 | Nixon | 251/96 |
| 3,157,038 | 11/1964 | Gilberton | 431/277 |
| 3,533,718 | 10/1970 | Shuto | 431/277 |
| 3,890,087 | 6/1975 | Jackson | 431/277 |

*Primary Examiner*—Edward G. Favors
*Assistant Examiner*—Robert J. Charvat
*Attorney, Agent, or Firm*—Irving Seidman

[57] ABSTRACT

A manually operated gas lighter for use for lighting barbecues, fireplaces, camp fires, ovens, and the like, which once ignited can be maintained ignited by providing a locking member to positively maintain the valve actuator in its depressed position. The locking member circumscribes the lighter body so as to be relatively rotated with respect to the lighter body, and which circumscribing member is provided with a slot which is constructed to receive and lock the valve actuator in its igniting position by effecting a predetermined relative rotational movement between the lighter and the circumscribing member.

4 Claims, 6 Drawing Figures

HOUSEHOLD AND BARBECUE TORCH LIGHTER

PRIOR ART

This is an improvement to disposable fireplace and oven lighter disclosed in my U.S. Pat. No. 3,890,087 granted June 17, 1975. Butane lighters of the type disclosed in U.S. Pat. Nos. 3,533,718 and 3,157,038 have acquired wide acceptance for use as a cigarette or cigar lighter. Such lighters are constructed so that ignition can be maintained only so long as an operator manually maintains the valve open with his thumb or finger. Generally the valve actuator and the ignition sparking wheel are relatively disposed so that sparking wheel and valve actuator can be substantially simultaneously actuated to effect ignition and ignition being maintained by a steady force being applied by the operator to the valve actuator to maintain the gas valve open.

For this reason such lighters could not be maintained ignited without the intervention of the operator. Also because a user had to maintain a steady force on the valve actuator to maintain ignition, such lighters were suitable for only intermittent operation for relatively short intervals of time. Also, such lighters could not be maintained in their ignited state and at the same time enable one to move one's hand to a safe holding position, which is necessary when such lighters are used for lighting an oven, fireplace, barbecue and the like. Thus the known butane lighters are only practical when the lighter is held in a vertical position as for example, to light a cigarette. Any effort to utilize the lighter in a non-vertical position would result in the flame to flare back uncomfortably close to the holder's hand.

OBJECTS

An object of this invention is to provide a butane lighter which can be readily ignited and which ignition can be positively maintained independently of any applied force on the part of the operator.

Another object is to provide a butane type lighter which can be readily used as a torch, and which can burn in any position without danger of the flame burning the operator.

Another object is to provide a gas lighter in which the valve actuator can be positively locked and unlocked between operative and inoperative positions.

Another object is to provide a gas lighter with an extended housing constructed to rotatably receive the gas lighter whereby the locking of the valve actuator is effected by relative rotation between the gas lighter and its extended housing.

BRIEF SUMMARY OF THE INVENTION

The foregoing objects and other advantages are attained by a gas lighter, e.g., of the butane type which has a lighter body containing a reservoir of volatile liquid fuel and a normally closed valve for controlling the flow of gaseous fuel. Associated with the valve in igniting relationship is a sparking wheel and a valve actuator. The relationship is such that an operator in striking the sparking wheel will substantially simultaneously actuate the actuator to open the gas valve. When this occurs, the lighter is ignited and is maintained ignited so long as the valve actuator is depressed in the open valve position.

To maintain the valve actuator depressed, the present invention contemplates a locking member which circumscribes the lighter body. In one form of the invention, the locking member comprises an elongated tubular housing which is open at one end for receiving the lighter body. The tubular housing is provided with a limit stop for limiting the extent that the lighter body extends into the housing.

Adjacent the upper end of the housing there is provided a bayonet type of slot for accommodating the actuator. The lighter body is mounted within the tubular housing so as to be frictionally retained therein and relatively rotatable with respect to the housing.

The slot is so formed that upon ignition of the lighter, the lighter can be rotated relative to the housing so that the actuator can be mechanically locked and maintained in the open valve position. In this manner the lighter can be maintained in an ignited position for a considerable period of time independent of any applied force on the part of the operator.

The flame of the lighter can be extinguished by effecting reverse rotation of the lighter body relative to the housing whereby the actuator is released to close the valve. In this manner the lighter can be used as a torch to light such things as an oven, barbecue grill, fireplace, stove and the like, which is not feasible with conventional butane lighters.

In another form of the invention, the butane lighter may be formed with an integrally constructed elongated lighter body. In this form, a circumscribing locking ring is rotatably journalled to the lighter body, and which ring is provided with a bayonet slot to accommodate and lock the valve actuator upon ignition by effecting rotation of the locking ring relative to the lighter body.

FEATURES

A feature of this invention resides in the provision of a rotational locking member relative to the lighter body for positively locking and maintaining the valve actuator in an open valve position for effecting continued ignition of the lighter.

Another feature resides in providing the locking member with an elongated tubular body whereby the lighter can be used as a torch.

Another feature resides in the provision wherein a conventional butane cigarette lighter can be readily adapted for use as a torch and/or used for purposes other than simply lighting cigarettes or cigars.

Another feature resides in the provision wherein the component parts are relatively simple in construction and can be readily fabricated.

Another feature resides in the provision wherein the lighter is rendered safe in operation and eliminates the need and danger of matches within or without the household.

Other features and advantages will become more readily apparent when considered in view of the drawings and detailed description wherein.

DETAILED DESCRIPTION

Figure 1:
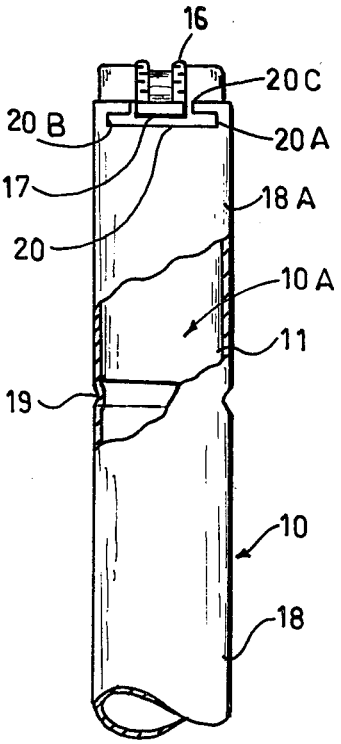
FIG. 1 is a front elevation view of a gas lighter and torch embodying the invention, and having portions thereof broken away.

Referring to the drawings there is shown in FIGS. 1 to 4 a gas lighter and torch construction 10 which embodies the present invention. The lighter portion 10A of the torch 10 comprises a gas lighter of a type, which utilizes a highly volatile liquid fuel; e.g., butane, which are generally known as butane gas lighters. Such gas lighters 10A have attained wide acceptance as a cigarette and cigar lighter. Such a lighter is disclosed in my U.S. Pat. No. 3,890,087 and is comprised essentially of a lighter body 11 which defines a reservoir 12 for containing a supply of volatile liquid fuel, e.g., butane. In the upper end of the reservoir 12 there is generally provided an outlet opening 13 which is connected to the inlet of a gas valve 14. The gas valve 14 is of a well known construction having a nozzle end 15 which is normally maintained in a closed position.

Mounted on the upper end of the lighter body 11 in ignition relationship to the gas valve or nozzle 15 is a sparking or ignition wheel 16. The periphery of the ignition wheel 16 is provided with a roughened surface which is disposed opposite a flint or spark generating means so that when the sparking wheel is rotated, a spark is generated which will ignite any gas flowing out through the nozzle. On the top of the gas lighter 11 in actuating position with respect to the sparking wheel 16 is a valve actuator 17. The valve actuator 17 generally comprises a lever having an extended end portion 17A which extends beyond the body 11 of the lighter 10A. The other end of the lever is operatively connected to the valve so that when the actuating lever 17 is depressed, the gas valve is opened as shown in the dotted lines in FIG. 4. The arrangement is such that an operator can substantially simultaneously upon actuating the sparking wheel 16 also cause the actuator 17 to be depressed thereby opening the gas valve 15 whereby the escaping gas can be readily ignited by the spark generated. The gas so ignited remains ignited so long as the operator maintains the actuating lever in its depressed state.

Figure 2:
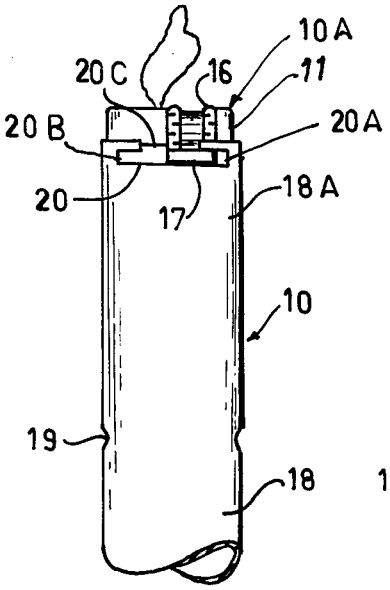
FIG. 2 illustrates a fragmentary portion of the gas lighter and torch of FIG. 1 shown in an operative or ignited position.
Figure 3:
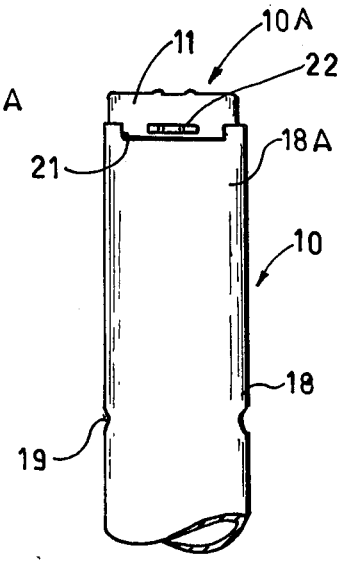
FIG. 3 illustrates a rear view portion of the upper end portion of the gas lighter and torch of FIG. 1.
Figure 4:
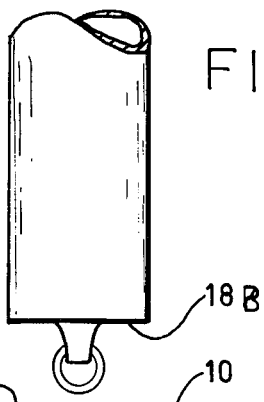
FIG. 4 is an enlarged detailed showing of the lighter head of the gas lighter and torch of FIG. 1.
Figure 4:
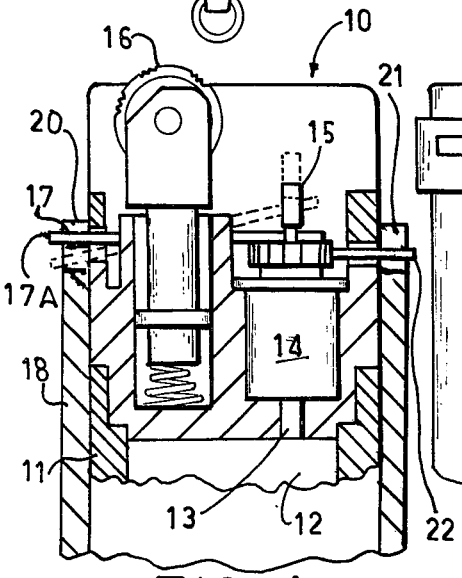

In accordance with the present invention, a means is provided whereby the foregoing described cigar or cigarette lighter 10A can be readily adapted for use as a torch and/or as a lighter for other purposes, e.g., fireplace, stove, barbecue, campfire, oven and the like. This is attained by providing a torch body or elongated tubular housing 18 which is opened at one end 18A and which opened end is arranged to receive the lighter 10A. As best seen in FIGS. 1, 2, and 3, the torch or elongated housing 18 comprises a tubular member which may be closed at its bottom end 18B. Intermediate the length of the tubular housing 18 there is provided a limiting means 19 for limited the extent to which the lighter body 11 extends onto the tubular housing 18. In the illustrated form of the invention, the limit means 19 is defined as a circumscribing depression to define a shoulder or stop to limit the extent that the lighter projects into the housing. Alternately, the limit means may comprise simply of a dimple or other suitable depression to limit the extent which the lighter body 11 extends into the housing. It is to be noted that the limit or stop means 19 is disposed so that the actuator 17 of the lighter 10A is disposed adjacent the upper end of the tubular housing or circumscribing member 18.

As best seen in FIGS. 1 and 2, the upper end of the tubular housing 18 is provided with a bayonet or "T" shaped slot 20 for accommodating the extended end 17A of the actuating lever 17 which extends beyond the periphery of the lighter body 11. As shown, slot 20 in FIGS. 1 and 2 is provided with lateral offset leg portions 20A and 20B and a stem portion 20C for normally accommodating the actuator 17 in the inoperative position of the lighter. The arrangement of the lighter 10A with respect to the tubular housing 18 is such that the lighter 10A is frictionally retained in the upper portion of the tubular member 18 and is rendered readily rotatable with respect to the housing portion 18. The tubular housing is sized so that the outer circumferential surface of the lighter body 10A is snugly received in the opened end 18A of the housing, and is frictionally retained therein but free to rotate relative thereto.

Opposite the bayonet slot 20, the housing 18 is provided with a notched out portion 21 (FIG. 3) which is provided for accommodating an adjusting lever 22 which is normally associated with such lighters 10A for regulating the flame size.

As best seen in FIG. 3, the notch portion 21 is made sufficiently wide so as to permit relative rotation between the lighter body 11 and the tubular housing 18. With the construction described, it will be noted that the cigarette lighter 10A of a generally known construction can be readily converted into a torch or appliance lighter, by simply inserting the lighter 10A into the upper portion of the tubular housing 18 as described.

In operation, the ignition of the lighter is effected in the manner hereinabove described. However, by effecting relative rotation of the lighter body 11 relative to the housing 18 when the actuator 17 is in its depressed state, will cause the actuator 17 to be shifted laterally into one of the angularly offset leg portions 20A or 20B of the slot 20, whereby the actuator is locked in a valve open position, whereby continuous burning of the escaping gases can be effected without the operator being required to manually hold the actuator in a depressed state. Thus with the lighter 10 positioned as indicated in FIG. 2, the lighter 10A is maintained in a constant ignited state until such time that the lighter 10A is rotated in the opposite direction to effect the release of the valve actuator 17. With the construction described, it will be noted that the lighter can be maintained locked in ignited position so that the torch can be used to light barbecues, stoves, fireplaces and the like. Also, the torch can be held in other positions other than vertical with no danger of back flaming or causing an operator to be burned when the torch is held in other than vertical position.

Because the lighter portion 10A is snugly held in place in the upper end of the tubular housing which is otherwise closed at its other end, a slight vacuum will occur when the lighter 10A is initially inserted into the top 18A of the tubular housing, and which vacuum cooperates with the snug fit to retain the lighter portion 10A in place even when the torch is inverted.

Figure 6:
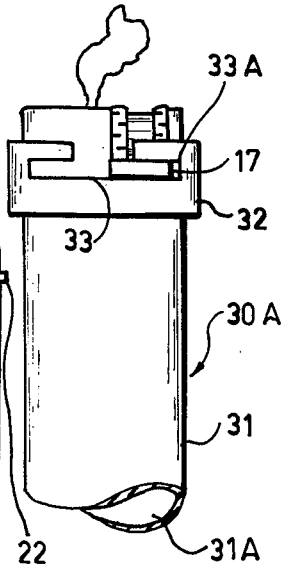
FIG. 6 is a fragmentary view of the gas lighter and torch of FIG. 5, but illustrating the parts in an ignited position.
Figure 5:
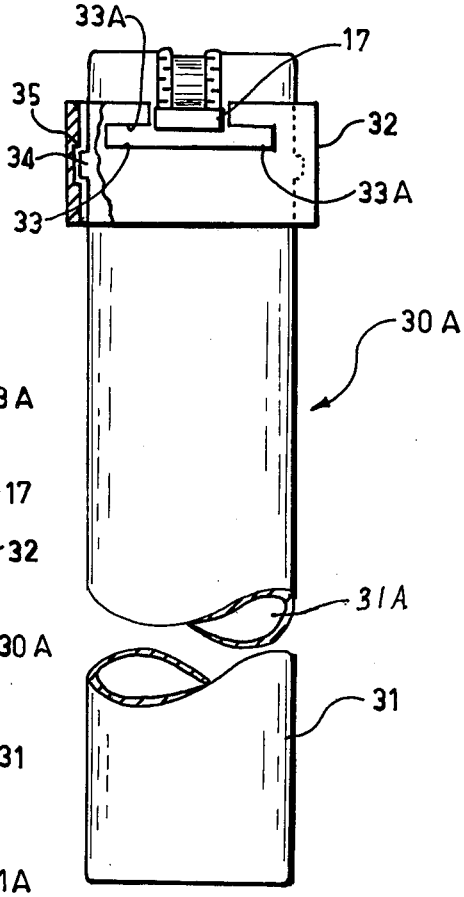
FIG. 5 is a front elevation view of a modified form of the invention.

FIGS. 5 and 6 illustrate a modified form of the invention. In this form of the invention, the lighter 30A is provided with an extended lighter body portion 31 whereby the extended length of the lighter body 31 can be utilized as the torch body. In this form, the reservoir portion 31A of the lighter 30A can be substantially enlarged. In this form of the invention, the circumscribing member 32 by which the valve actuator 17 can be maintained in a locked, operative or ignited position comprises a locking ring 32 which is provided with a bayonet slot 33 similar in construction to that described with respect to FIGS. 1 and 2. As best seen in FIG. 5, the lighter body 31 is provided with a circumscribing annular shoulder 34 which is adapted to complement a circumscribing recess 35 formed in the internal wall of the locking ring 32. In this arrangement it will be noted that the locking ring 32 is readily rotatable relative to the lighter body.

In operation, the ignition of the lighter 30A is effected in the manner hereinbefore described, and the valve actuator 17 is maintained in a locked, operative position by rotating the locking member 32 so that the lateral or offset leg portion 33A of the slot 33 receives the valve actuator 17 as indicated in FIG. 6. As shown in FIG. 6, the lighter remains ignited until such time that the valve actuator 17 is released by counter-rotation of the lighter 30A relative to the locking ring 32.

In all other respects, the construction, function and operation of the lighter 30A is similar to that hereinbefore described with respect to FIGS. 1 to 4.

While the present invention has been described with respect to several embodiments thereof, it will be readily appreciated and understood that variations and modifications may be made without departing from the spirit or scope of the invention.

What is claimed is:

1. A gas lighter comprising:

a lighter body having a reservoir portion for holding a supply of volatile liquid fuel, a normally closed valve for controlling the flow of gaseous fuel from said reservoir, a sparking ignition means disposed in igniting relationship with said normally closed valve, a valve actuator connected to said normally closed valve, means for pivotally mounting said valve actuator on said lighter body, said actuator having a portion extending beyond the periphery of said lighter body, means for positively maintaining and locking said valve actuator in the open valve position for maintaining said lighter ignited upon ignition, said latter means, including a member circumscribing said lighter body, said circumscribing member being mounted for rotation relative to said lighter body, and said circumscribing member having a slot formed therein for accommodating the extended portion of said valve actuator, said slot having a lateral offset leg portion for receiving said extended portion in the opened valve position upon effecting a predetermined relative rotation between said lighter body and said circumscribing member so as to positively lock said valve actuator in the open valve position for maintaining ignition, said lighter including a flame adjusting lever, and said circumscribing member includes a notched out portion for accommodating said adjusting lever, said notched out portion being disposed opposite said slot.

2. The invention as defined in claim 1 wherein said slot is "T" shaped with the stem of said "T" shaped slot being disposed in alignment with said valve actuator in the closed valve position of said actuator.

3. The invention as defined in claim 1 wherein said circumscribing member includes a ring rotatably mounted to said lighter body immediately adjacent said valve actuator.

4. The invention as defined in claim 1 wherein said circumscribing member includes an elongated tubular housing having an open end portion for accommodating said lighter body, said tubular housing includes a means for limiting the extent said lighter projects into said tubular housing, said slot includes a second lateral offset leg portion to define a "T" shaped slot wherein said opposed leg portions define the cross arm of said "T" shaped slot disposed in spaced relationship to the periphery of said open end of said housing, and said "T" shaped slot having a stem portion for receiving said extended portion of said valve actuator.

* * * * *